US008656841B2

(12) United States Patent
Taguchi et al.

(10) Patent No.: US 8,656,841 B2
(45) Date of Patent: Feb. 25, 2014

(54) BODYSHELL STRUCTURE OF RAILCAR

(75) Inventors: Makoto Taguchi, Akashi (JP); Masashi Ishizuka, Kobe (JP); Atsushi Sano, Kakogawa (JP); Toshiyuki Yamada, Kobe (JP); Hideki Kumamoto, Akashi (JP); Seiichiro Yagi, Akashi (JP); Masayuki Tomizawa, Akashi (JP); Atsushi Sano, Kakogawa (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 13/810,103

(22) PCT Filed: Jul. 12, 2011

(86) PCT No.: PCT/JP2011/003983

§ 371 (c)(1),
(2), (4) Date: Feb. 6, 2013

(87) PCT Pub. No.: WO2012/008146

PCT Pub. Date: Jan. 19, 2012

(65) Prior Publication Data

US 2013/0139718 A1 Jun. 6, 2013

(30) Foreign Application Priority Data

Jul. 12, 2010 (JP) ..... 2010-157607

(51) Int. Cl.
*B61D 25/00* (2006.01)

(52) U.S. Cl.
USPC ..... 105/396; 105/397

(58) Field of Classification Search
USPC ..... 105/396, 397, 400, 404, 409; 156/60, 156/280
See application file for complete search history.

(56) References Cited

U.S. PATENT DOCUMENTS 5,042,395 A * 8/1991 Wackerle et al. ..... 105/397
5,333,554 A * 8/1994 Yamada et al. ..... 105/397
5,353,502 A 10/1994 Hattori et al.

(Continued)

FOREIGN PATENT DOCUMENTS

JP Y1-37-1937 2/1962
JP B1-39-23473 10/1964

(Continued)

OTHER PUBLICATIONS

Oct. 11, 2011 International Search Report issued in International Application No. PCT/JP2011/003983.

*Primary Examiner* — Jason C Smith
(74) *Attorney, Agent, or Firm* — Oliff PLC

(57) ABSTRACT

The present invention is a bodyshell structure of a railcar, the bodyshell structure including: a side bodyshell including an outside plate portion, an inside plate portion, and a joint portion configured to join the outside plate portion and the inside plate portion; an inside window opening formed on the inside plate portion and provided inside the railcar; and an outside window opening formed on the outside plate portion and having a smaller opening area than the inside window opening, and at least one of the inside window opening and the outside window opening has an oval shape extending in the railcar longitudinal direction or a circular shape.

3 Claims, 12 Drawing Sheets

(56) References Cited

U.S. PATENT DOCUMENTS

| | | | | |
|---|---|---|---|---|
| 5,433,151 | A * | 7/1995 | Ohara et al. | 105/397 |
| 5,480,729 | A | 1/1996 | Hattori et al. | |
| 5,669,999 | A * | 9/1997 | Anderegg et al. | 156/173 |
| 5,685,229 | A * | 11/1997 | Ohara et al. | 105/397 |
| 5,890,435 | A * | 4/1999 | Thoman et al. | 105/404 |
| 6,196,136 | B1 * | 3/2001 | Yoshizaki et al. | 105/396 |
| 6,554,348 | B1 * | 4/2003 | Gernstein | 296/178 |
| 6,866,329 | B2 * | 3/2005 | Clifford | 296/181.1 |
| 7,958,831 | B2 * | 6/2011 | Campus | 105/396 |
| 2007/0214998 | A1 * | 9/2007 | Komaki et al. | 105/396 |
| 2007/0295240 | A1 * | 12/2007 | Campus | 105/396 |
| 2008/0011188 | A1 * | 1/2008 | Campus | 105/401 |
| 2009/0255437 | A1 | 10/2009 | Hachet et al. | |
| 2012/0042805 | A1 * | 2/2012 | Umebayashi et al. | 105/396 |
| 2012/0067247 | A1 * | 3/2012 | Umebayashi et al. | 105/396 |
| 2013/0139718 | A1 * | 6/2013 | Taguchi et al. | 105/329.1 |

FOREIGN PATENT DOCUMENTS

| | | |
|---|---|---|
| JP | B1-40-6292 | 3/1965 |
| JP | B1-40-6293 | 3/1965 |
| JP | Y1-40-33606 | 11/1965 |
| JP | A-05-038539 | 2/1993 |
| JP | A-06-183340 | 7/1994 |
| JP | U-06-50921 | 7/1994 |
| JP | A-10-194117 | 7/1998 |
| JP | A-10-315961 | 12/1998 |
| JP | A-2000-247226 | 9/2000 |
| JP | A-2000-335409 | 12/2000 |
| JP | A-2004-082955 | 3/2004 |
| JP | A-2004-338601 | 12/2004 |
| JP | A-2005-088012 | 4/2005 |
| JP | A-2009-214876 | 9/2009 |

* cited by examiner

THICKNESS [mm]

THICKNESS [mm]

THICKNESS [mm]

BODYSHELL STRUCTURE OF RAILCAR

TECHNICAL FIELD

The present invention relates to a bodyshell structure of a railcar, and particularly to a bodyshell structure configured to improve ride quality and be reduced in mass.

BACKGROUND ART

In recent years, a reduction in mass of railcars has been demanded with an increase in speed of the railcars, and railcars that are improved in comfort of passengers, such as ride quality, have been strongly demanded. In response to these, known is a railcar bodyshell that is improved in the ride quality by reducing the sizes of side windows to increase bending stiffness of the bodyshell.

Known as one of the structures of side bodyshells of railcars is a double skin structure using an aluminum alloy hollow extruded section constituted by two face plates and ribs each coupling these face plates to each other. The reduction in mass and the improvement in ride quality of the railcar having the above structure have also been demanded. In response to these, PTL 1 proposes a railcar bodyshell configured such that only the thickness of a face plate of a hollow section constituting a pier panel that is a portion between windows of the side bodyshell is uniformly increased in a railcar longitudinal direction as compared to the thickness of a face plate of the other hollow section constituting the side bodyshell. PTL 1 describes that the railcar bodyshell that is high in bending stiffness and light in mass can be provided by the above configuration.

CITATION LIST

Patent Literature

PTL 1: Japanese Laid-Open Patent Application Publication No. 10-194117

SUMMARY OF INVENTION

Technical Problem

However, if the sizes of the side windows are reduced, passengers' visions from the inside of the railcar are limited, so that open feeling decreases. In addition, in the railcar bodyshell described in PTL 1, since the thickness of the face plate of the hollow section constituting the pier panel is increased in the railcar longitudinal direction, the bending stiffness can be increased, but the problem is that the mass of the railcar increases.

Here, an object of the present invention is to provide a bodyshell structure of railcar, the bodyshell structure being increased in bending stiffness, improved in ride quality, and reduced in mass.

Solution to Problem

The present invention is a bodyshell structure of a railcar, the bodyshell structure including: a side bodyshell including an outside plate portion, an inside plate portion, and a joint portion configured to join the outside plate portion and the inside plate portion; an inside window opening formed on the inside plate portion and provided inside the railcar; and an outside window opening formed on the outside plate portion and having a smaller opening area than the inside window opening, wherein at least one of the inside window opening and the outside window opening has an oval shape extending in a railcar longitudinal direction or a circular shape.

With this, while preventing the eyesight of passengers and the like from being significantly influenced, the bending stiffness can be increased by increasing areas in the vicinities of upper and lower edges of a pier panel portion. Thus, the stiffness of the bodyshell can be increased without increasing only the thickness of the pier panel portion unlike conventional cases. Therefore, the ride quality can be improved, and the reduction in mass can be realized. Moreover, each of the inside window opening and the outside window opening has a circular shape, and the opening area of the outside window opening formed on the outside plate portion is smaller than that of the inside window opening formed on the inside plate portion. Therefore, the area of the outside plate portion at the pier panel portion can be made larger than that of the conventional side window opening portion. On this account, the bending stiffness of the bodyshell can be increased, and the ride quality can be improved.

BRIEF DESCRIPTION OF DRAWINGS

FIG. 1A is a side view. FIG. 1B is a perspective view showing a part of the carbody when viewed from the outside of a railcar. FIG. 1C is a perspective view showing a part of the carbody when viewed from the inside of the railcar. FIG. 1D is a partially enlarged view showing a portion between side window opening portions when viewed from the inside of the railcar.

FIG. 2A is a side view. FIG. 2B is a perspective view showing a part of the carbody when viewed from the outside of the railcar. FIG. 2C is a perspective view showing a part of the carbody when viewed from the inside of the railcar. FIG. 2D is a partially enlarged view showing the portion between the side window opening portions when viewed from the inside of the railcar.

[FIGS. 3A to 3D] Each of FIGS. 3A and 3B is a partially enlarged view of the side window opening portions. FIG. 3A shows the side window opening portions of Embodiment 1. FIG. 3B shows conventional side window opening portions.

FIG. 4 is a partially enlarged view of the side window opening portions included in Embodiment 1 when viewed from the inside of the railcar.

FIG. 5 is a partially enlarged view of the portion between the side window opening portions in Modification Example of Embodiment 1 when viewed from the inside of the railcar.

FIG. 6A shows the optimization result of the bodyshell structure according to Embodiment 1. FIG. 6B shows the optimization result of the bodyshell structure according to Modification Example of Embodiment 1. FIG. 6C shows the optimization result of a conventional bodyshell structure.

FIG. 7A is a side view. FIG. 7B is a perspective view showing a part of the carbody when viewed from the outside of the railcar. FIG. 7C is a perspective view showing a part of the carbody when viewed from the inside of the railcar. FIG. 7D is a partially enlarged view of the portion between the side window opening portions when viewed from the inside of the railcar.

FIGS. 8A and 8B respectively correspond to FIGS. 1A and 1D.

FIG. 9A shows the side window opening portions of Embodiment 2. FIG. 9B shows the conventional side window opening portions.

FIG. 10 is a diagram of Modification Example of Embodiment 2 and corresponds to FIG. 7D.

FIG. 11A shows the optimization result of the bodyshell structure according to Embodiment 2. FIG. 11B shows the optimization result of the bodyshell structure according to Modification Example of Embodiment 2. FIG. 11C shows the optimization result of the conventional bodyshell structure.

FIG. 12A shows a relation between a large window opening portion and the seat. FIG. 12B shows a relation between a small window opening portion and the seat.

FIG. 13 is an explanatory diagram of the shape of the window opening portion of Embodiment 1.

DESCRIPTION OF EMBODIMENTS

Figure 12A:
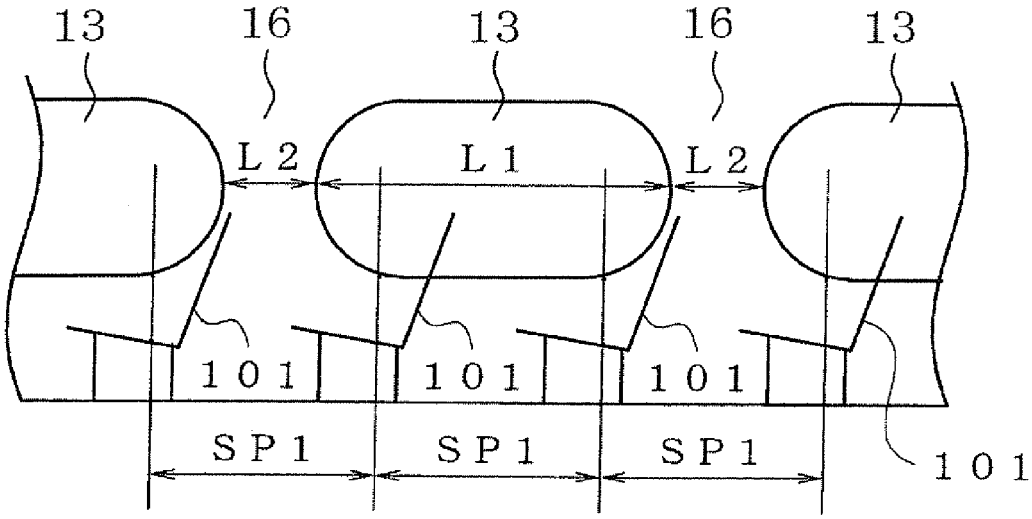
[FIGS. 12A to 12B] Each of FIGS. 12A and 12B shows a relation between a window opening portion and a seat.
Figure 12B:
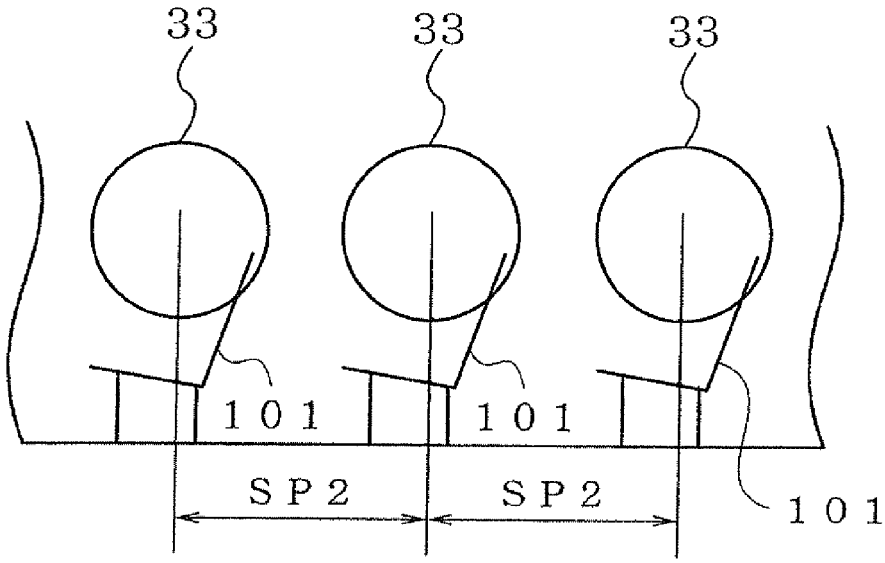

Hereinafter, bodyshell structures of railcars according to embodiments of the present invention will be explained in reference to the drawings. In Embodiment 1, side window opening portions are large window opening portions. In Embodiment 2, side window opening portions are small window opening portions. Here, the large window opening portion is a window portion whose length in a railcar longitudinal direction is larger than a seat pitch between two transverse seats (so-called cross seats). For example, as shown in FIG. 12A, a length L1 of a large window opening portion 13 in the railcar longitudinal direction is a length obtained by subtracting a length L2 of a pier panel portion 16 in the railcar longitudinal direction from a length that is twice a seat pitch SP1 between transverse seats 101 adjacent to each other in the railcar longitudinal direction ($L1=2\times SP1-L2$). The small window opening is a window portion whose length in the railcar longitudinal direction is smaller than the seat pitch between two cross seats. For example, as shown in FIG. 12B, one small window opening portion 33 of Embodiment 2 is provided for each transverse seat 101, and a pitch between adjacent small window opening portions 33 is equal to a seat pitch SP2.

Embodiment 1

Figure 1A:
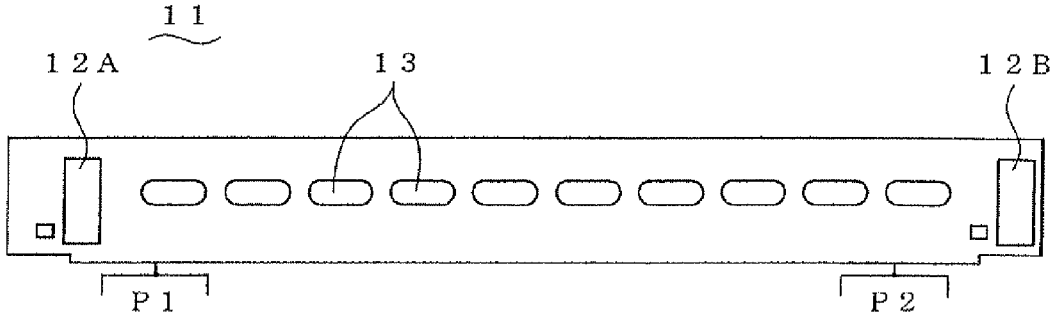
[FIGS. 1A to 1D] Each of FIGS. 1A to 1D shows the schematic configuration of a carbody included in Embodiment 1.
Figure 1B:
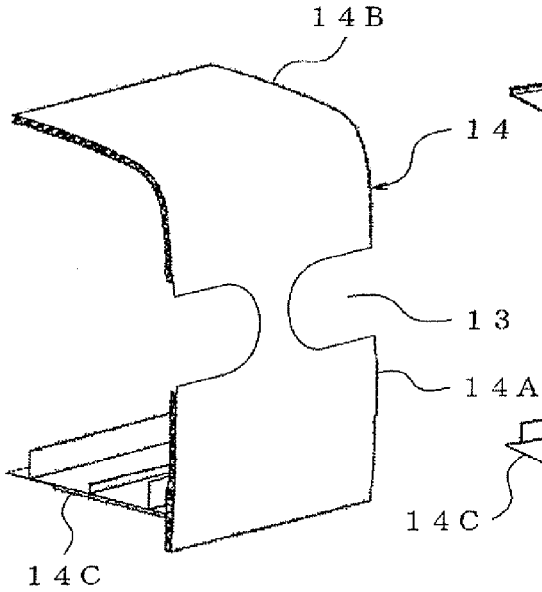
Figure 1C:
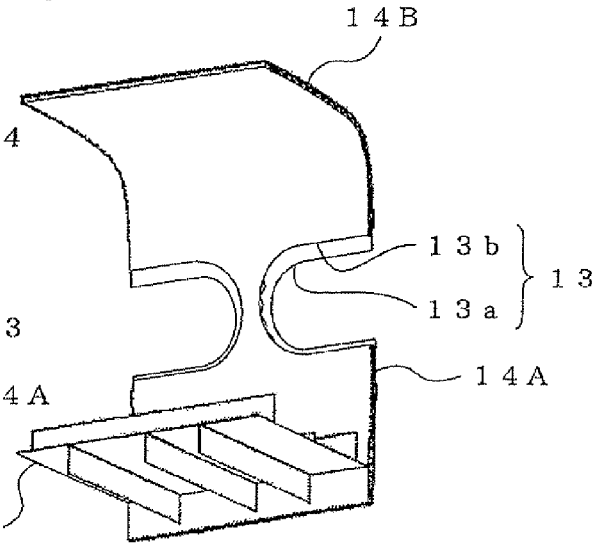
Figure 1D:
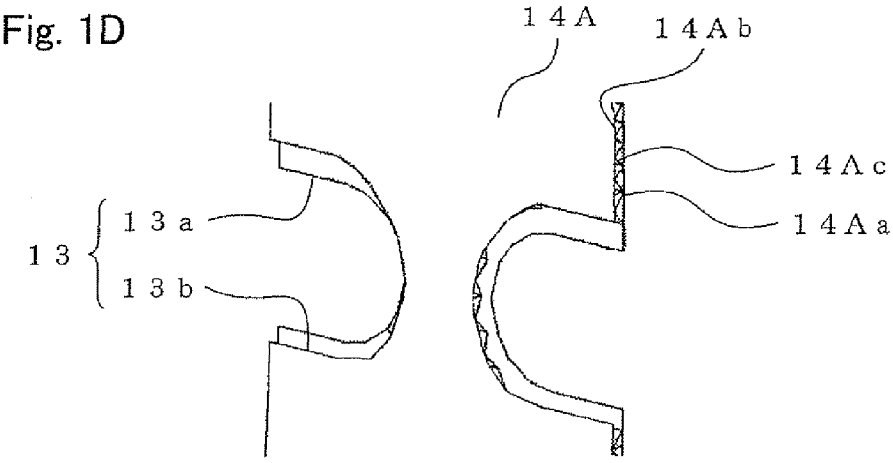

Each of FIGS. 1A to 1D shows the schematic configuration of a carbody included in Embodiment 1. FIG. 1A is a side view. FIG. 1B is a perspective view showing a part of the carbody when viewed from the outside of the railcar. FIG. 1C is a perspective view showing a part of the carbody when viewed from the inside of the railcar. FIG. 1D is a partially enlarged view of a portion between side window opening portions when viewed from the inside of the railcar. In the drawings, reference signs P1 and P2 denote fulcrums supporting a carbody 11 and respectively correspond to portions of truck bolsters of front and rear truck frames.

As shown in FIGS. 1A to 1D, the carbody 11 of the railcar includes a side bodyshell 14A. A roof bodyshell 14B is coupled to an upper portion of the side bodyshell 14A, and an underframe 14C is connected to a lower portion thereof. The side bodyshell 14A includes entrance opening portions 12A and 12B and a plurality of side window opening portions 13. The side bodyshell 14A has an aluminum alloy double skin structure which includes an outside plate portion 14Aa, an inside plate portion 14Ab, and a web portion (joint portion) 14Ac and in which the outside plate portion 14Aa and the inside plate portion 14Ab are coupled to each other by the web portion 14Ac.

The entrance opening portions 12A and 12B are respectively formed at front and rear side portions of the side bodyshell 14A. The side window opening portions 13 are formed between the entrance opening portions 12A and 12B at regular intervals along the railcar longitudinal direction. Hereinafter, details of the side window opening portion 13 will be explained.

Figure 13:
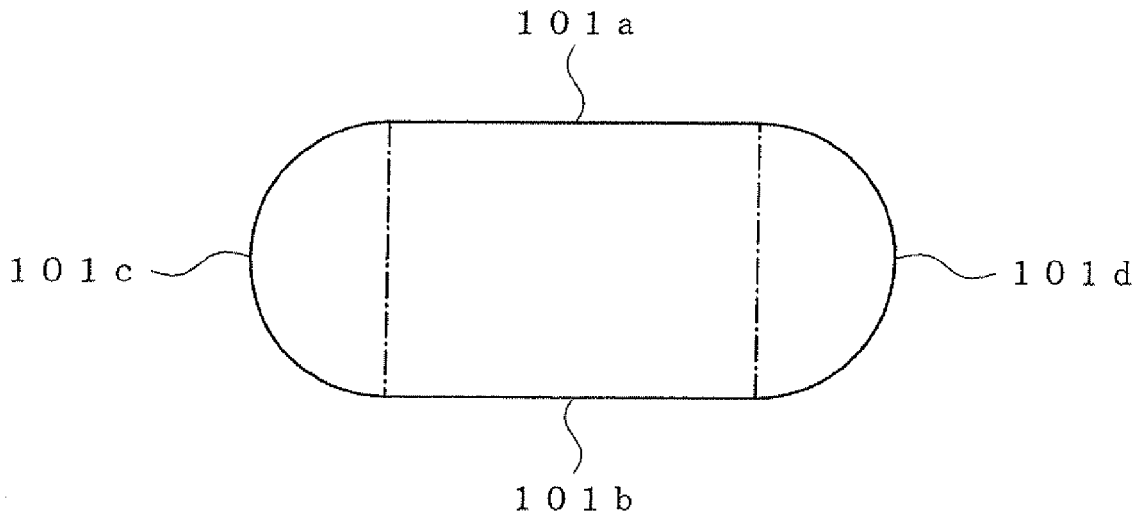
[FIG. 13]

As shown in FIGS. 1B to 1D, the side window opening portions 13 include outside window openings 13*a* formed on the outside plate portion 14Aa and inside window openings 13*b* formed on the inside plate portion 14Ab. Each of the outside window opening 13*a* and the inside window opening 13*b* is a long hole having an oval shape that is long in the railcar longitudinal direction. Here, as shown in FIG. 13, the "oval shape" is a shape formed by two straight portions 101*a* and 101*b* parallel to each other and two substantially semicircular portions 101*c* and 101*d* (radius R). For example, in a case where a welded joint is positioned at a part of the oval shape, the oval shape herein includes a shape that is devised at this part to avoid the occurrence of stress concentration. The inside window opening 13*b* is formed by cutting off the inside plate portion 14Ab and the web portion 14Ac. An opening area of the inside window opening 13*b* is larger than that of the outside window opening 13*a*. This is because a window unit including window glass and a sash is attached from the inside of the railcar. As above, when viewed from the inside of the railcar, the side window opening portion 13 has a single skin structure in which only the outside plate portion 14Aa exists.

Figure 2A:
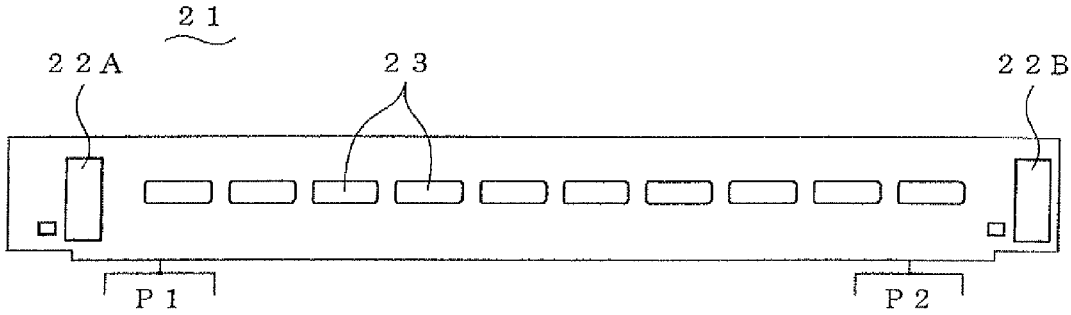
[FIGS. 2A to 2D] Each of FIGS. 2A to 2D shows the schematic configuration of a conventional carbody.
Figure 2B:
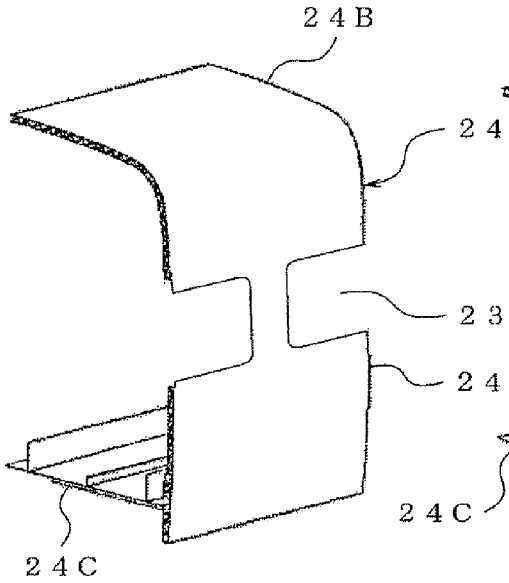
Figure 2C:
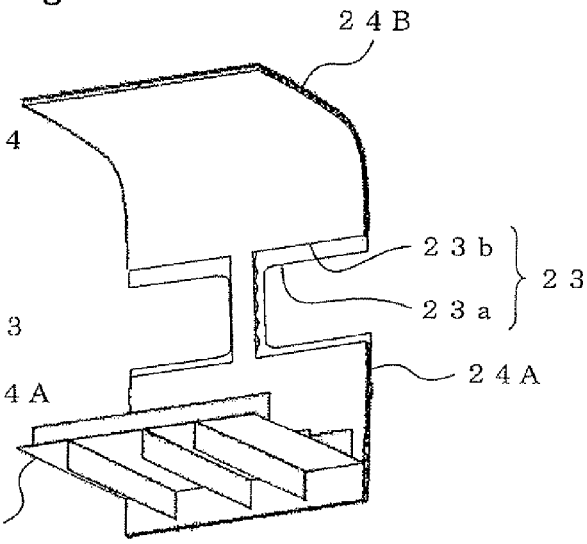
Figure 2D:
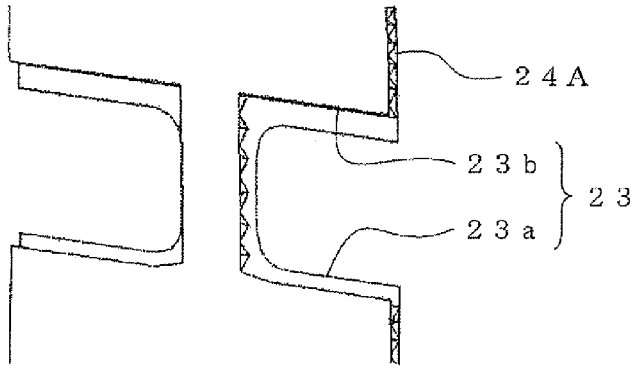

Next, differences between a conventional side window opening portion and the side window opening portion of the present embodiment will be explained. Each of FIGS. 2A to 2D shows the schematic configuration of a conventional carbody. FIG. 2A is a side view. FIG. 2B is a perspective view showing a part of the carbody when viewed from the outside of the railcar. FIG. 2C is a perspective view showing a part of the carbody when viewed from the inside of the railcar. FIG. 2D is a partially enlarged view of a portion between the side window opening portions when viewed from the inside of the railcar.

A conventional carbody 21 includes entrance opening portions 22A and 22B respectively formed at front and rear side portions of a side bodyshell 24A. Side window opening portions 23 are formed between the entrance opening portions 22A and 22B at regular intervals along the railcar longitudinal direction. As with the above embodiment, the side bodyshell 24A has an aluminum alloy double skin structure including an outside plate portion, an inside plate portion, and a web portion (joint portion). Here, a reference sign 24B denotes a roof bodyshell coupled to an upper portion of the side bodyshell 24A, and a reference sign 24C denotes an underframe connected to a lower portion of the side bodyshell 24A. As shown in FIGS. 2B to 2D, the side window opening portions 23 include outside window openings 23*a* formed on the outside plate portion of the side bodyshell 24A and inside window openings 23*b* formed on the inside plate portion of the side bodyshell 24A. Each of the outside window opening 23*a* and the inside window opening 23*b* is a long hole having a rectangular shape that is long in the railcar longitudinal direction.

Figure 3A:
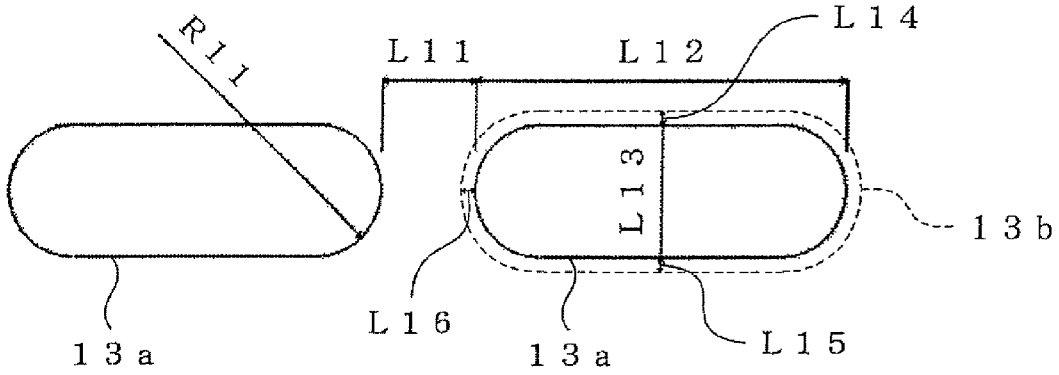
Figure 3B:
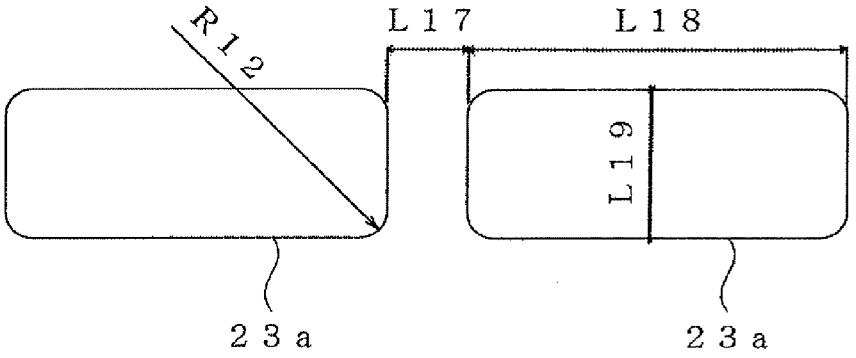

Each of FIGS. 3A and 3B is a partially enlarged view of the side window opening portion. FIG. 3A shows the side window opening portion of Embodiment 1. FIG. 3B shows the conventional side window opening portion.

In FIG. 3A, regarding the outside window openings 13*a* of the present embodiment, an interval L11 between the adjacent outside window openings 13*a* is 400 mm, a length L12 of the outside window opening 13*a* in the railcar longitudinal direction is 1,560 mm, a length L13 of the outside window opening 13*a* in a railcar vertical direction is 560 mm, and a curvature radius R11 of a curved portion of each corner of the outside window opening 13*a* is 280 mm. Further, an upper interval L14 between the outside window opening 13*a* and the inside window opening 13*b* is 109 mm, a lower interval L15 therebetween is 47 mm, and each of left and right intervals L16 is 42 mm.

In FIG. 3B, regarding the conventional side window opening portions 23, an interval L17 between the adjacent outside window openings 23*a* is 360 mm, a length L18 of the outside window opening 23*a* in the railcar longitudinal direction is 1,600 mm, a length L19 of the outside window opening 23*a* in the railcar vertical direction is 650 mm, and a curvature radius R12 of a curved portion of each corner of the outside window opening 23*a* is 125 mm.

As above, the area of the pier panel portion between the side window opening portions 13 of the present embodiment is larger than that of the pier panel portion between the conventional side window opening portions 23. With this, it is possible to realize the bodyshell structure that is increased in stiffness with respect to vertical loads acting on the carbody 11 by using the portions P1 and P2 of the truck bolsters of the truck frames as the fulcrums.

In the present embodiment, regarding the seats in a seat arrangement (so-called cross seat arrangement) in which each seat on which a passenger is seated is provided orthogonal to a rail direction of the carbody 11, the length of the side window opening portion 13 in the railcar longitudinal direction is larger than the pitch between the seats adjacent to each other in the railcar longitudinal direction and is preferably about 1.5 times the pitch. By adjusting the pitch between the seats and the length of the pier panel portion, one side window opening portion 13 is arranged for two seats. In a case where the railcar runs in any direction along the railcar longitudinal direction, the visions from the side window opening portions 13 can be secured for the passengers on the seats. For example, in a case where the length of the side window opening portion 13 in the carbody longitudinal direction is set to 1,560 mm to 1,680 mm or more, and the side window opening portion 13 is set to be larger than the window of the conventional carbody, the wide vision from the inside of the railcar can be secured, the open feeling can be offered to the passengers, and the comfort can be improved. In addition, since the area of the pier panel portion can be made larger than that of the conventional structure, the bending stiffness of the bodyshell can be increased, and the ride quality can be improved.

Figure 4:
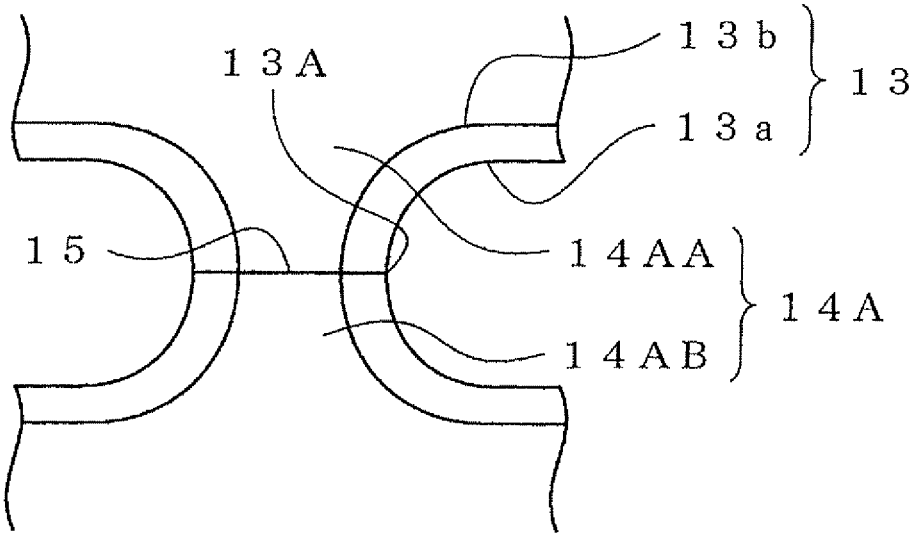
[FIG. 4]

As shown in FIG. 4, a short straight portion 13A extending in the railcar vertical direction is formed at a railcar-vertical-direction center of the side window opening portion 13 (the outside window opening 13*a* and the inside window opening 13*b*) or in the vicinity of this center. Then, the side bodyshell 14A is formed by joining at least an upper side bodyshell portion 14AA and a lower side bodyshell portion 14AB that are separable in the railcar vertical direction. Therefore, a welded joint 15 extending in the carbody horizontal direction at the side bodyshell portions 14AA and 14AB is set to be located at a portion of the straight portion 13A. With this, the stress can be prevented from concentrating on a portion of the welded joint 15 of the side window opening portion 13. Here, the length of the straight portion 13A is set to 1% to 10% of an entire vertical height of the side window opening portion 13.

Figure 5:
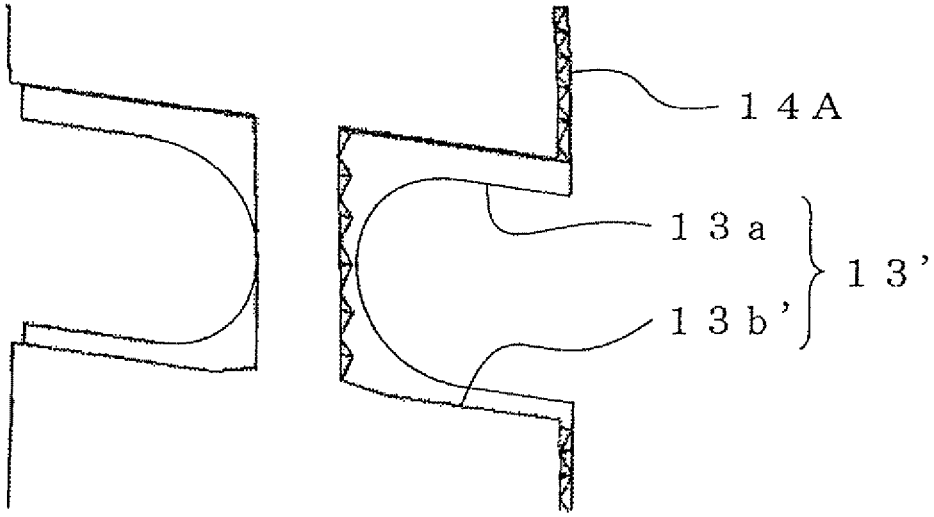
[FIG. 5]

In the present embodiment, the shape of the inside window opening 13*b* is the oval shape corresponding to the shape of the outside window opening 13*a*. However, the present embodiment is not limited to this. For example, as shown in FIG. 5, the shapes may be such that the outside window opening 13*a* has an oval shape, and an inside window opening 13*b*' of a side window opening portion 13' has a rectangular shape. To be specific, the inside window opening 13*b*' may be formed as a rectangular opening whose upper and lower edges are parallel to each other and whose front and rear edges are parallel to each other.

Regarding the bodyshell including the above configuration, an analysis of a natural frequency of the carbody was carried out. The natural frequency of the carbody 21 (see FIGS. 2A to 2D) including the conventional side window opening portion 23 was 8.3 Hz (7.59 tons in mass). The natural frequency of the carbody 11 shown in FIGS. 1A to 1D was 9.3 Hz (7.73 tons in mass), and the natural frequency of the carbody including the side window opening portion 13' shown in FIG. 5 was 9.1 Hz (7.72 tons in mass). According to the above results, the natural frequency of the carbody can be increased in the railcar bodyshell of the present embodiment. Therefore, the bending stiffness of the bodyshell can be increased, and the ride quality can be improved.

Next, an optimization analysis was carried out, which minimizes the mass of the bodyshell on condition that a design variable is the thickness of the extruded section of the aluminum alloy double skin structure, a limiting condition is the natural frequency of the carbody, and an objective function is the mass of the bodyshell. In order to secure satisfactory ride quality of the railcar, it is preferable that the natural frequency of the carbody be set to be higher than the natural frequency of a spring system of the truck by 1 Hz or more. Here, in the present embodiment, the natural frequency of the spring system of the truck is set to N Hz, and the natural frequency of the carbody that is the limiting condition is set to N+1.2 Hz.

Figure 6A:
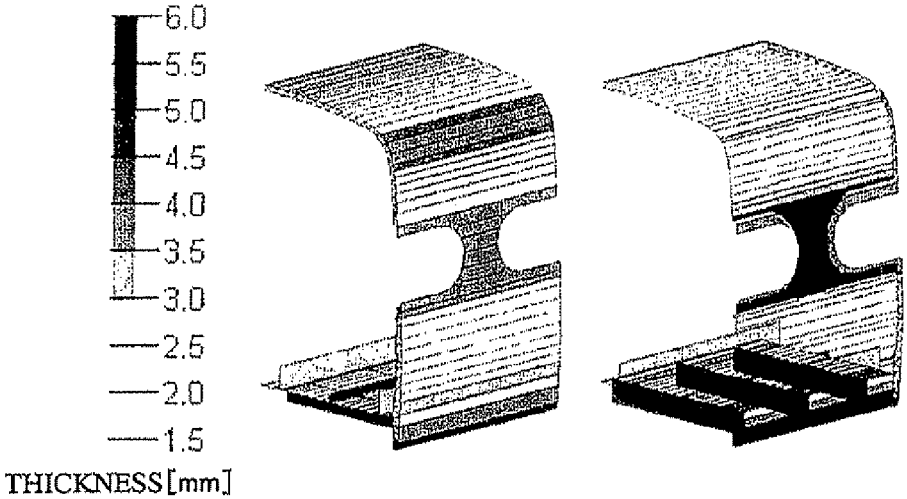
[FIGS. 6A to 6C] Each of FIGS. 6A to 6C is a diagram showing an optimization result of a thickness distribution.
Figure 6B:
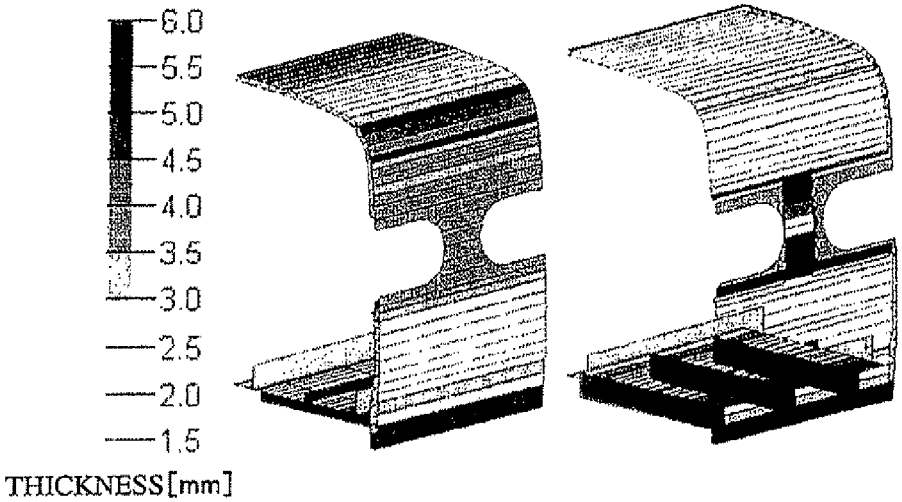
Figure 6C:
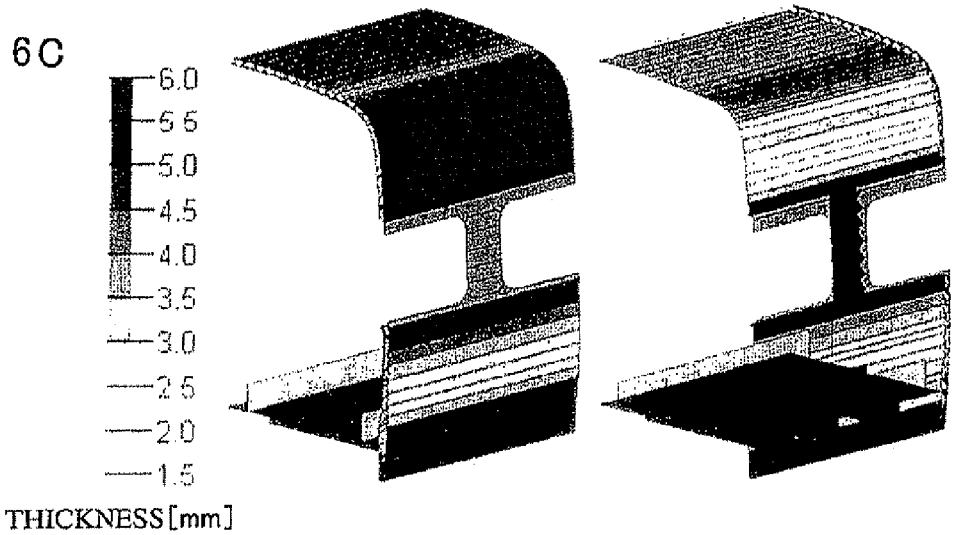

Each of FIGS. 6A to 6C is a diagram showing the optimization result of the thickness distribution. FIG. 6A shows the optimization result of the bodyshell structure according to Embodiment 1. FIG. 6B shows the optimization result of the bodyshell structure including the side window opening portion 13' shown in FIG. 5. FIG. 6C shows the optimization result of the conventional bodyshell structure shown in FIGS. 2A to 2D. According to the result of the above computer simulations, in order to increase the natural frequency of the carbody of the conventional bodyshell structure up to N+1.2 Hz, the thickness distribution becomes the thickness distribution shown in FIG. 6C, and the mass of the bodyshell increases by 1.86 tons. In the case of the bodyshell structure of the present embodiment, the thickness distribution becomes the thickness distribution shown in FIG. 6A or 6B, and the mass of the bodyshell increases only by 0.38 ton or 0.68 ton. The optimization results shown in FIGS. 6A to 6C are results in a case where the natural frequency N of the spring system of the truck was set to 8.5 Hz. However, it has been confirmed that the same results as above can be obtained even if the natural frequency N of the spring system of the truck varies.

As above, according to the bodyshell structure of the railcar of the present embodiment, the ride quality is improved, and the comfort is increased. In addition, the reduction in mass of the railcar can be realized.

Embodiment 2

Next, the bodyshell structure of the railcar according to Embodiment 2 will be explained. The present embodiment has substantially the same configuration as Embodiment 1 but is different from Embodiment 1 in that the side window opening portion has a circular shape. Hereinafter, differences therebetween will be mainly explained.

Figure 7A:
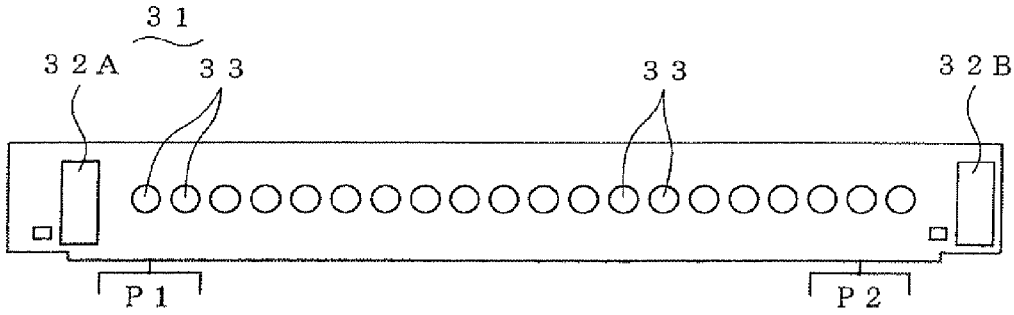
[FIGS.7A to 7D] Each of FIGS. 7A to 7D shows the schematic configuration of the carbody included in Embodiment 2.
Figure 7B:
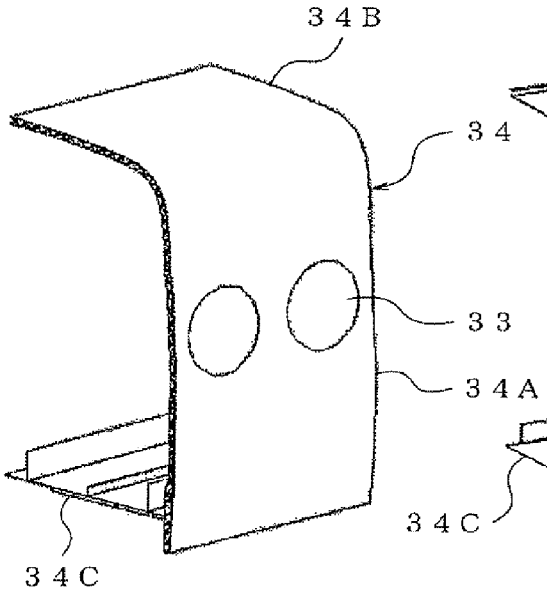
Figure 7C:
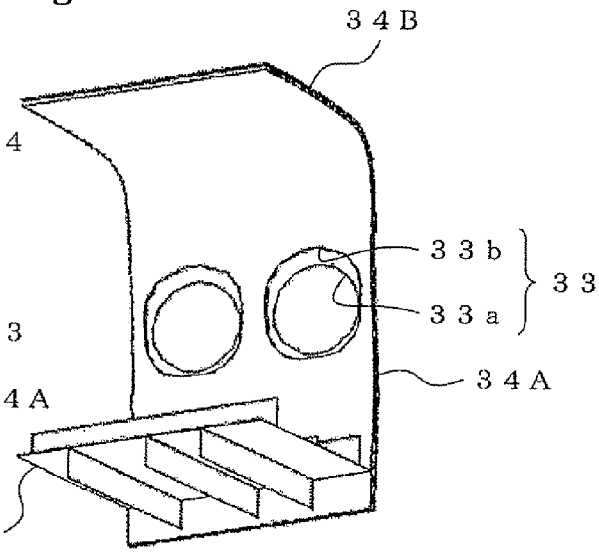
Figure 7D:
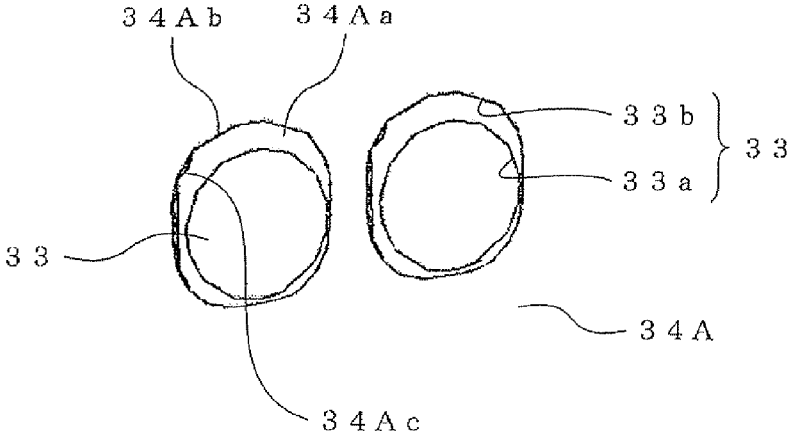

Each of FIGS. 7A to 7D shows the schematic configuration of the carbody included in Embodiment 2. FIG. 7A is a side view. FIG. 7B is a perspective view showing a part of the carbody when viewed from the outside of the railcar. FIG. 7C is a perspective view showing a part of the carbody when viewed from the inside of the railcar. FIG. 7D is a partially enlarged view showing a portion between the side window opening portions when viewed from the inside of the railcar.

As shown in FIGS. 7A to 7D, each of a plurality of side window opening portions 33 formed on a side bodyshell 34A has a substantially perfect circular shape. Reference signs 34B and 34C respectively denote a roof bodyshell and an underframe. The side bodyshell 34A has an aluminum alloy double skin structure including an outside plate portion, an inside plate portion, and a web portion (joint portion).

As shown in the enlarged view of FIG. 7D, an outside window opening 33*a* formed on an outside plate portion 34Aa is a round hole having a substantially perfect circular shape. With this, a curvature radius of a corner portion of the outside window opening 33*a* is larger than a curvature radius of a corner portion of a conventional outside window opening 43*a*.

An inside window opening 33*b* formed on an inside plate portion 34Ab is a round hole having a substantially circular shape corresponding to the shape of the outside window opening 33*a*, and the opening area of the inside window opening 33*b* is larger than that of the outside window opening 33*a*. When viewed from the inside of the railcar, the side window opening portion 33 has a single skin structure in which only the outside plate portion 34Aa exists. As with Embodiment 1 (see FIG. 4), a short straight portion extending in the railcar vertical direction is formed at a railcar-vertical-direction center of the side window opening portion 33 (the outside window opening 33*a* and the inside window opening 33*b*) or in the vicinity of this center, and a welded joint of the upper side bodyshell portion and the lower side bodyshell portion is located at the straight portion. The length of the short straight portion is set to 1% to 10% of an entire vertical height of the side window opening portion 33.

Figure 8A:
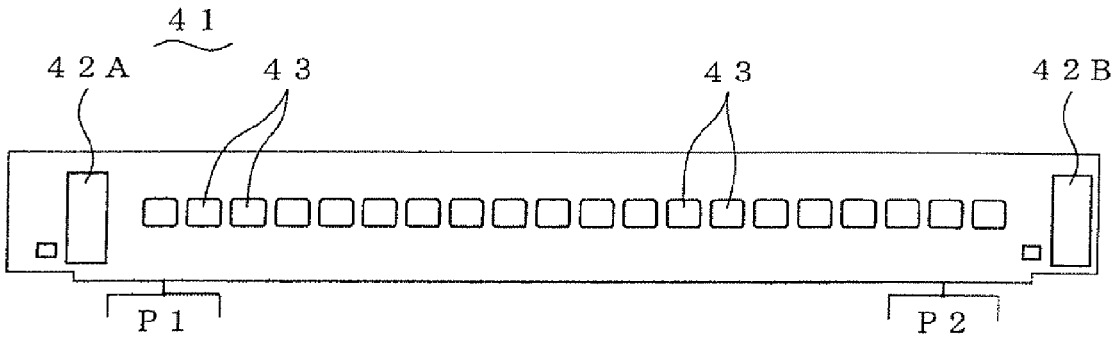
[FIGS.8A to 8B] Each of FIGS. 8A and 8B is a diagram showing the configuration of the conventional carbody.
Figure 8B:
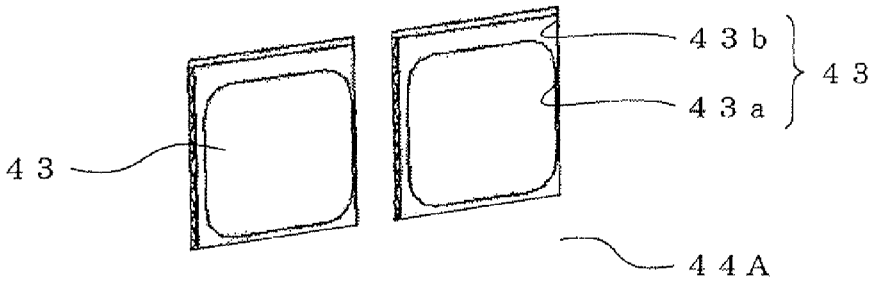

Next, differences between a conventional side window opening portion 43 and the side window opening portion 33 of the present embodiment will be explained. Each of FIGS. 8A and 8B is a diagram showing the configuration of the carbody of the conventional railcar. FIG. 8A is a side view. FIG. 8B is an enlarged view of the side window opening portion 43 when viewed from the inside of the railcar. The side window opening portions 43 include the outside window openings 43*a* formed on the outside plate portion of a side bodyshell 44A and inside window openings 43*b* formed on the inside plate portion of the side bodyshell 44A. Each of the outside window opening 43*a* and the inside window opening 43*b* is a hole having a rectangular shape. The opening area of the inside window opening 43*b* is larger than that of the outside window opening 43*a*.

Figure 9A:
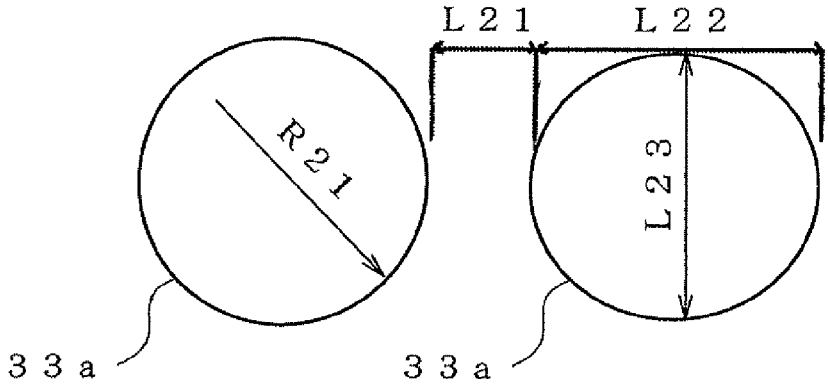
[FIGS.9A to 9B] Each of FIGS. 9A and 9B is a partially enlarged view of the side window opening portions.
Figure 9B:
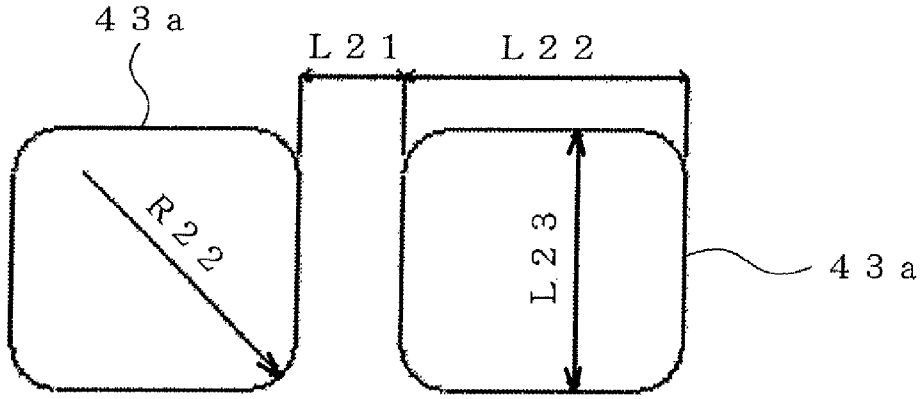

Each of FIGS. 9A and 9B is a partially enlarged view of the side window opening portion. FIG. 9A shows the side window opening portion of Embodiment 2. FIG. 9B shows the conventional side window opening portion.

In FIG. 9A, regarding the side window opening portions 33 of the present embodiment, an interval L21 between the adjacent side window opening portions 33 is 270 mm, a length L22 of the outside window opening 33*a* in the railcar longitudinal direction is 710 mm, a length L23 of the outside window opening 33*a* in the railcar vertical direction is 650 mm, and a curvature radius R21 of a curved portion of each corner of the outside window opening 33*a* is 325 mm.

In FIG. 9B, regarding the conventional side window opening portions 43, the interval L21 between the adjacent outside window openings 43*a* is 270 mm, the length L22 of the outside window opening 43*a* in the railcar longitudinal direction is 710 mm, the length L23 of the outside window opening 43*a* in the railcar vertical direction is 650 mm, and a curvature radius R22 of a curved portion of each corner of the outside window opening 43*a* is 125 mm.

As above, in the present embodiment, the outside window opening 33*a* has a substantially circular shape formed such that curved portions each having a larger curvature radius than the curved portion of the conventional outside window opening 43*a* are respectively formed at four corners of the outside window opening 33*a*.

Figure 10:
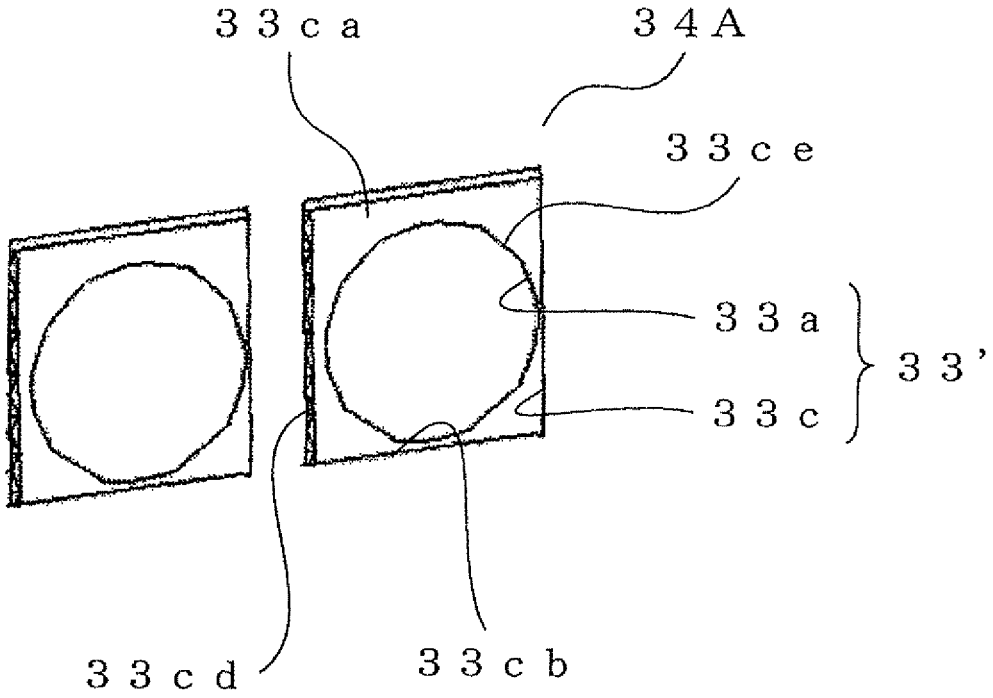
[FIG. 10]

In the present embodiment, the shape of the inside window opening 33*b* corresponds to the shape of the outside window opening 33*a*. However, the present embodiment is not limited to this. For example, as shown in FIG. 10, an inside window opening 33*c* may be formed to have a rectangular shape. To be specific, upper and lower edges 33*ca* and 33*cb* of the inside window opening 33*c* are parallel to each other, and front and rear edges 33*cd* and 33*ce* thereof are parallel to each other. In this configuration, the outside window opening 33*a* is provided at a center of the inside window opening 33*c*.

Regarding the bodyshell including the above configuration, an analysis of a natural frequency of the carbody was carried out. The natural frequency of the carbody (see FIGS. 8A and 8B) including the conventional side window opening portion 43 was 8.7 Hz (7.64 tons in mass). The natural frequency of the carbody (see FIG. 7A to 7D) including the side window opening portion 33 of the present embodiment was 9.5 Hz (7.74 tons in mass). In a case where the shape of the inside window opening 33*c* was a rectangular shape in the present embodiment (see FIG. 10), the natural frequency of the carbody was 9.3 Hz (7.67 tons in mass). According to the above results, the natural frequency of the carbody can be increased in the railcar bodyshell of the present embodiment. Therefore, the bending stiffness of the bodyshell can be increased, and the ride quality can be improved.

With this, as with Embodiment 1, the natural frequency of the carbody can be increased by increasing the curvature radius of the curved portion of the corner portion of the side window opening portion.

Next, an optimization analysis was carried out, which minimizes the mass of the bodyshell on condition that the design variable is the thickness of the extruded section of the aluminum alloy double skin structure, the limiting condition is the natural frequency of the carbody, and the objective function is the mass of the bodyshell. In order to secure satisfactory ride quality of the railcar, it is preferable that the natural frequency of the carbody be set to be higher than the natural frequency of the spring system of the truck by 1 Hz or more. Here, in the present embodiment, the natural frequency of the spring system of the truck is set to N Hz, and the natural frequency of the carbody that is the limiting condition is set to N+1.2 Hz.

Figure 11A:
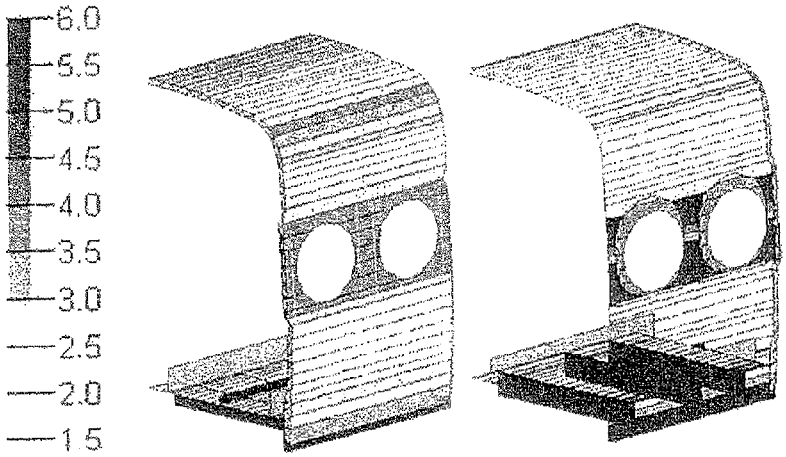
[FIGS. 11A to 11C] Each of FIGS. 11A to 11C is an explanatory diagram showing the optimization result of the thickness distribution.
Figure 11B:
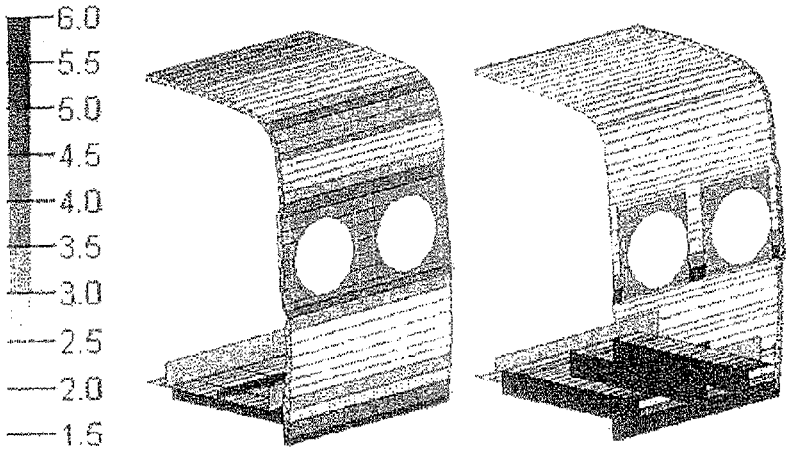
Figure 11C:
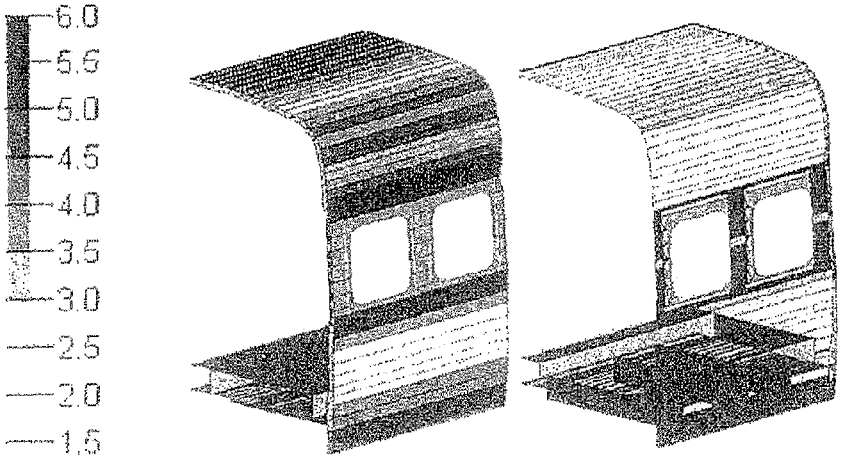

Each of FIGS. 11A to 11C shows the result of the optimization analysis. FIG. 11A shows the thickness distribution of the bodyshell structure shown in FIGS. 7A to 7D. FIG. 11B shows the thickness distribution of the bodyshell structure shown in FIG. 10. FIG. 11C shows the thickness distribution of the conventional bodyshell structure shown in FIGS. 8A and 8B. According to the above results, in order to increase the natural frequency of the carbody of the conventional bodyshell structure up to N+1.2 Hz, the thickness distribution becomes the thickness distribution shown in FIG. 11C, and the mass of the bodyshell increases by 1.36 tons. In the case of the bodyshell structure of the present embodiment, the thickness distribution becomes the thickness direction shown in FIG. 11A or 11B, and the mass of the bodyshell increases only by 0.19 ton or 0.34 ton. As above, according to the bodyshell structure of the railcar of the present embodiment, the ride quality is improved, and the comfort is increased. In addition, the reduction in mass of the railcar can be realized.

As above, according to the bodyshell structure of the railcar of the present embodiment, the ride quality is improved, and the comfort is increased. In addition, the reduction in mass of the railcar can be realized.

In Embodiment 2, the shape of the side window opening is a substantially perfect circular shape but may be an elliptical shape. The present invention is not limited to the above-described embodiments, and modifications, additions, and eliminations may be made within the spirit of the present invention.

The invention claimed is:

1. A bodyshell structure of a railcar, comprising:

a side bodyshell including an outside plate portion, an inside plate portion, and a joint portion configured to join the outside plate portion and the inside plate portion;

an inside window opening formed on the inside plate portion and provided inside the railcar; and an outside window opening formed on the outside plate portion and having a smaller opening area than the inside window opening, wherein:

the outside window opening has an oval shape extending in a railcar longitudinal direction or a circular shape;

the side bodyshell is formed by joining at least an upper side bodyshell and a lower side bodyshell, which are separable in a railcar vertical direction;

a joint portion of the upper side bodyshell and the lower side bodyshell is located at a straight portion formed at the outside window opening and the inside window a opening to extend in the railcar vertical direction; and a length of the straight portion is 1% to 10% of a vertical height of the inside window opening.

2. The bodyshell structure according to claim 1, wherein the inside window opening is formed by cutting off the inside plate portion and the joint portion.

3. The bodyshell structure according to claim 1, wherein each of a length of the inside window opening in the railcar longitudinal direction and a length of the outside window opening in the railcar longitudinal direction is larger than an interval between seats adjacent to each other in the railcar longitudinal direction.

* * * * *